United States Patent [19]

Alexander

[11] Patent Number: 4,791,800

[45] Date of Patent: Dec. 20, 1988

[54] ROLL FORMING PROCESS AND APPARATUS FOR MAKING RIBS IN STRIP MATERIAL

[75] Inventor: Robert D. Alexander, Fremont, Calif.

[73] Assignee: Pacific Roller Die Co., Inc., Hayward, Calif.

[21] Appl. No.: 113,248

[22] Filed: Oct. 26, 1987

[51] Int. Cl.[4] ..... B21D 5/14; B21D 13/10

[52] U.S. Cl. ..... 72/180; 72/137; 72/379

[58] Field of Search ..... 72/179–182, 72/177, 176, 137, 379

[56] References Cited

U.S. PATENT DOCUMENTS

| | | | |
|---|---|---|---|
| 1,056,962 | 3/1913 | White | 72/181 |
| 2,708,958 | 5/1955 | Crafton | 72/180 |
| 2,907,369 | 1/1959 | Brauer | 72/180 |

FOREIGN PATENT DOCUMENTS

| | | | |
|---|---|---|---|
| 867034 | 9/1941 | France | 72/180 |
| 23774 | 7/1972 | Japan | 72/180 |
| 162228 | 7/1986 | Japan | 72/180 |
| 240581 | 10/1925 | United Kingdom | 72/180 |

*Primary Examiner*—Daniel C. Crane

*Attorney, Agent, or Firm*—Ernest M. Anderson

[57] ABSTRACT

A roll forming process is described wherein longitudinal areas of curvature are formed in strip material between longitudinal areas of narrower width, the areas of curvature being bowed downwardly from the center toward the longitudinal flat areas. As the strip material is fed progressively through roll forming stations, the longitudinal areas of curvature are formed into areas of lesser curvature and finally flattened to provide strip material having relative flat areas separated by substantially rectangular ribs. The process is one in which areas of curvature are provided to initially gather strip material for use in forming the sides of one or more ribs with little or no thinning of the strip material.

11 Claims, 2 Drawing Sheets

P
R
5
13
12
11
10
2
3
4
5
5
5

ROLL FORMING PROCESS AND APPARATUS FOR MAKING RIBS IN STRIP MATERIAL

SUMMARY OF THE INVENTION

This invention relates generally to the helical manufacture of pipe and more particularly to the method of forming ribs in strip material used in forming such pipe. The invention utilizes a roll forming process wherein longitudinal areas of curvature are formed between longitudinal areas of narrower width, the areas of curvature being bowed downwardly from the center toward the longitudinal flat areas. As the strip material is fed progressively through roll forming stations, the longitudinal areas of curvature are formed into areas of lesser curvature and finally flattened to provide strip material having relative flat areas separated by substantially rectangular ribs. The process is one in which areas of curvature are provided to initially gather strip material for use in forming the sides of one or more ribs with little or no thinning of the strip material.

A principal object of the invention is to provide a roll forming process and apparatus for forming a plurality of ribs that extend longitudinally of the strip material without causing a substantial thinning of the material, particularly in the corners of the ribs.

Another object of the invention is to provide strip material having substantially rectangular ribs to form helical ribbed pipe of superior strength and rigidity.

Other objects of this invention will become apparent in view of the following detailed description.

In the drawings forming part of this application and in which like parts are identified by like reference numerals throughout the same:

FIG. 6 is a transverse section of strip formed with the apparatus shown in FIGS. 1-5.

DESCRIPTION OF THE PREFERRED EMBODIMENT

Figure 1:
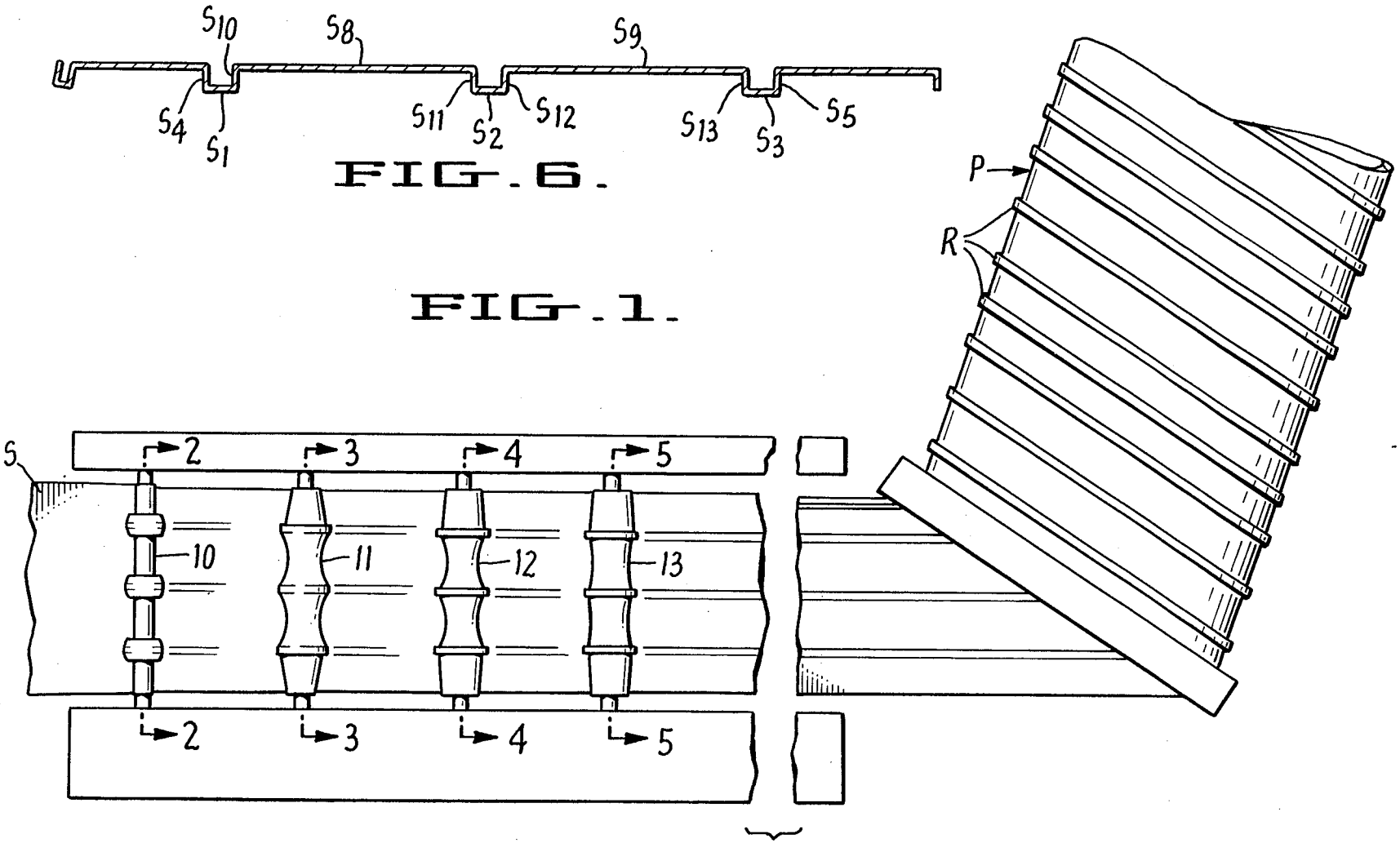
FIG. 1 is a plan view of one section of a pipe forming apparatus which embodies a preferred embodiment of the invention in roll forming three longitudinal ribs in strip material.

Referring to FIG. 1, there is shown an apparatus for forming pipe P with spiral ribs R in a manner contemplated by this invention. It to be understood that strip material S is fed from left to right as shown through a series of roller dies comprising roll stands 10, 11, 12 and 13. These roll stands produce a series of three ribs in the strip material which is then coiled to form helical pipe P. Additional roll forming stands are provided to the right (or downstream) of roll stand 13 to further flatten curved areas of the strip and form edges for lock seaming as shown, for example, in U.S. Pat. No. 3,247,692.

Figure 2:
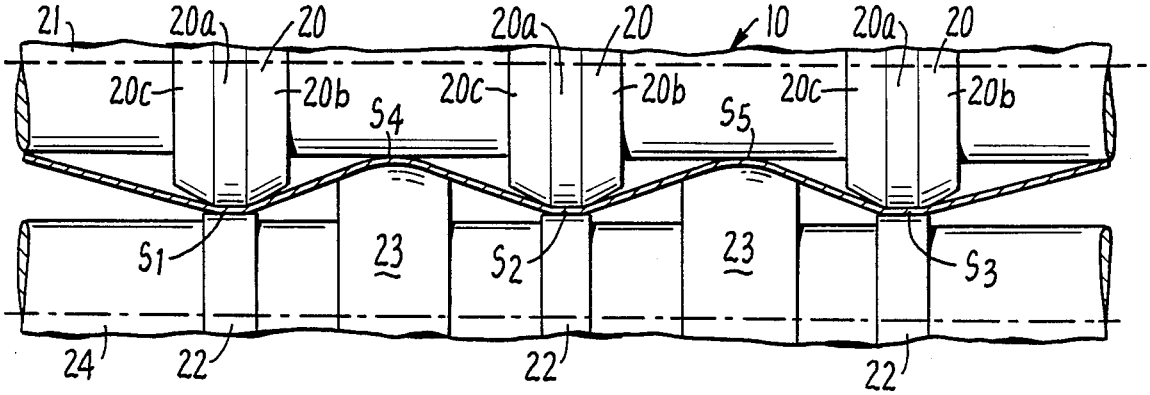
FIG. 2 is a partial section taken on the line 2—2 of FIG. 1.

Referring to FIGS. 2-5, there is shown a sequential series of steps in roll forming the strip material as contemplated by the invention. FIG. 2 illustrates roll stand 10 having a set of three upper die rolls 20 mounted on an arbor 21. Each roll 20 has a flat center surface area 20*a* approximately dimensioned to the inner size of the rib being formed. Each roll 20 also has a pair of side surface areas 20*b* and 20*c* which provide angular relief allowing the strip to be bent upwardly as shown while forming the inner corners of a rib.

Roll stand 10 also includes a set of three lower rolls 22 and a pair of rolls 23 supported on an arbor 24. Rolls 22 are generally aligned with rolls 20 to provide backing and support for forming flat areas $S_1$, $S_2$ and $S_3$ in the strip S. These flat areas eventually become the base side of a substantially rectangular rib. Rolls 23 deform the strip upward and form initial areas of curvature $S_4$ and $S_5$ intermediate rolls 20.

Figure 3:
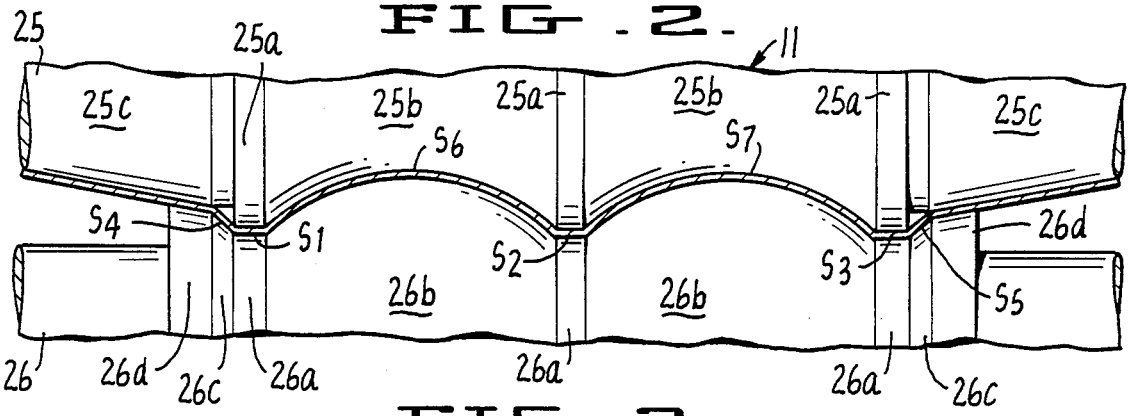
FIG. 3 is a partial section taken on the line 3—3 of FIG. 1.

FIG. 3 illustrates the shape of roller dies at roll stand 11 which comprises an upper roll bar 25 and a lower roll bar 26. Roll bar 25 provides a set of three relatively flat areas 25*a* which correspond in width to the surface areas 20*a* of roller dies 20, and a pair of concave surface areas 25*b* intermediate areas 25*a*.

Lower roll bar 26 complements roll bar 25 in providing relatively flat areas 26*a* which correspond and are aligned with areas 25*a*. A pair of convex surfaces 27*b* are located opposite surfaces 25*b* of roll bar 25. The arcuate length of the concave and convex surfaces substantially equals the strip distance between the edges of adjacent flat surfaces $S_1$, $S_2$ and $S_3$ formed in roll stand 10. Thus, in reforming the strip material in roll stand 11, there is little or no thinning of the metal at the corners of the ribs which are being formed.

Roll stand 26 further provides roller surface areas 26*c* and 26*d*. These surfaces cooperate with roll surfaces 25*c* to initiate the formation of relatively flat sides adjacent to flat surfaces $S_1$ and $S_3$, respectively.

Figure 4:
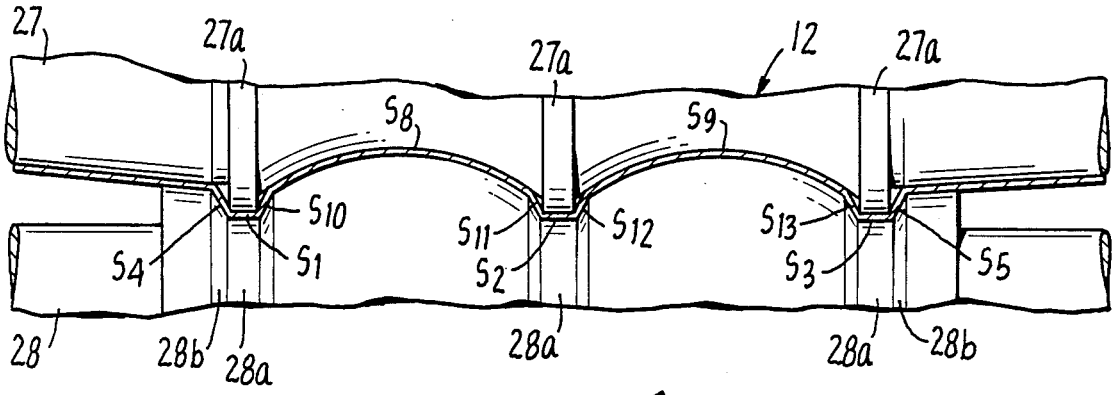
FIG. 4 is a partial section taken on the line 4—4 of FIG. 1.

At roll stand 12, shown in FIG. 4, there is provided a pair of complementary roll bars 27 and 28. The roller surfaces provided on these roll bars serve to flatten the areas of curvature $S_6$ and $S_7$ and form lesser areas of curvature $S_8$ and $S_9$ and areas of relative flatness $S_{10}$, $S_{11}$, $S_{12}$ and $S_{13}$. For that purpose, roll bar 27 is formed with three areas of flatness 27*a* which correspond in width to surface areas 20*a* and 25*a;* and roll bar 28 is formed with areas of flatness 28*a* that correspond in dimension with areas 26*a*. Roll surfaces 28*b* tend to move the side edges of the strip inwardly, increasing the angle of bend at the juncture of flat areas $S_1$-$S_4$ and $S_3$-$S_5$.

Figure 5:
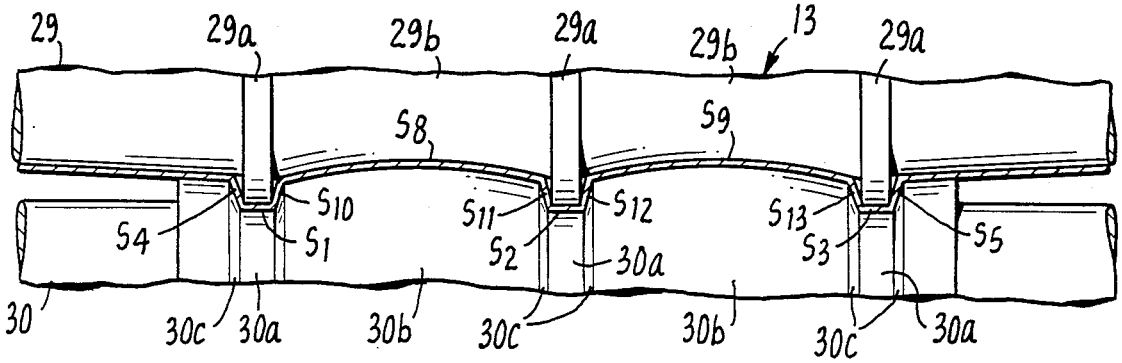
FIG. 5 is a partial section taken on the line 5—5 of FIG. 1.

Referring to FIG. 5, roll stand 13 comprises a pair of rolls 29 and 30. Roll 29 provides relative flat surface areas 29*a* which correspond to flat areas 20*a*, 25*a* and 27*a;* and roll 30 provides areas of flatness 30*a* which conform to surfaces 26*a* and 28*a*. A pair of concave surface areas 29*b* formed on roll bar 29 and a pair of complementary convex rolls 30*b* on roll bar 30 are shaped to further flatten the areas of curvature $S_8$ and $S_9$ with little or no drawing of metal at the bends which form the ribs in the strip. Simultaneously, the edges of the strip are moved inwardly by surface areas 30*c* on either side of surface areas 30*a* to define three substantially U-shaped ribs.

It is contemplated that further roll stands may be used, if desired, to better define a set of rectangular ribs in the strip, such as illustrated in the final shape of the strip shown in FIG. 6, immediately prior to helically coiling the strip to form pipe. In such instances, the roll stand would comprise a set of rolls having the exact configuration to form the strip as shown while maintaining the dimensional integrity of each rib.

The apparatus shown and described represents a roll forming process for making ribs in strip material which comprises the steps of roll forming at least one longitudinal area of curvature between two longitudinal flat areas of narrower width. The longitudinal area of curvature, it will be noted, is bowed downwardly from its center toward the longitudinal flat areas. Next, the forming process progressively roll forms longitudinal areas of curvature to areas of lesser curvature and shorter widths separated by ribs which each comprises a longitudinal flat area of narrower width intermediate side areas of relative flatness. Thereafter, the areas of lesser curvature are roll formed to areas of relative flatness separated by substantially rectangular ribs. The process is particularly characterized in that strip material is initially gathered in areas of curvature for use in forming the sides of one or more ribs with little or no thinning of the strip material.

Although a preferred embodiment of the invention has been illustrated and described, various modifications and changes can be resorted to without departing from the spirit of the invention or the scope of the appended claims, and each of said modifications and changes is contemplated.

What is claimed is:

1. A roll forming process for making ribs in strip material to produce helical ribbed pipe and comprising the steps:

roll forming at least one longitudinal area of curvature between two longitudinal flat areas, said flat areas having a width more narrow than said area of curvature, said longitudinal area of curvature being bowed downwardly from its center toward said longitudinal flat areas;

progressively roll forming said longitudinal areas of curvature into areas of lesser curvature and lesser arcuate length separated by ribs, each rib comprising a longitudinal flat area of narrower width and longitudinal side areas of relative flatness, then roll forming said areas of lesser curvature to longitudinal areas of relative flatness separated by substantially rectangular ribs;

whereby strip material is initially gathered in longitudinal areas of curvature for use in forming the sides of one or more ribs with little or no thinning of the strip material.

2. The roll forming process of claim 1, a pair of longitudinal areas of curvature being formed, each spaced inwardly relative to one side edge of the strip material and between longitudinal flat areas of narrower width.

3. A roll forming process for making ribs in strip material to produce helical ribbed pipe comprising the steps:

roll forming two longitudinal areas of curvature that project between side edges of the strip material, each longitudinal area of curvature being bowed downwardly from its center;

simultaneously roll forming three longitudinal flat areas, said flat areas having a width more narrow than said areas of curvature, one of said flat areas of narrower width being intermediate said two longitudinal areas of curvature, the other two flat areas of narrower width being between one edge of the strip material and one longitudinal area of curvature;

roll forming said longitudinal areas of curvature into areas of lesser curvature and lesser arcuate length separated by a rib that comprises one of said longitudinal flat areas of narrower width and longitudinal side areas of relative flatness;

then roll forming said areas of lesser curvature to areas of relative flatness separated by three substantially rectangular ribs; whereby strip material is initially gathered in longitudinal areas of curvature for use in forming the sides of one or more ribs with little or no thinning of the strip material.

4. A roll forming process for producing ribs in strip material comprising the steps:

forming at least two longitudinal areas of curvature that project between side edges of the strip material, said side edges being moved inwardly into a predetermined spaced distance relationship, each longitudinal area of curvature being bowed downwardly from its center;

simultaneously roll forming a first longitudinal flat area intermediate the two areas of curvature, said longitudinal flat area having a width substantially less than the longitudinal areas of curvature and substantially equal to the interior rib width that is to be formed;

then roll forming two longitudinal flat areas between said two longitudinal areas of curvature, each flat area being angularly offset to and on opposite sides of said first longitudinal flat area using strip material from said two areas of curvature;

whereby strip material is initially gathered in longitudinal areas of curvature for use in forming the sides of one or more ribs with little or no thinning of the strip material.

5. The process of claim 4 and thereafter flattening the areas of curvature to cause the two sides to each rib to move toward each other and form a substantially rectangular rib.

6. The process of claim 4, wherein the longitudinal areas of curvature are formed inwardly relative to the side edges of the strip material and between one side of each of two ribs, thereby forming three ribs.

7. The process of claim 4, wherein longitudinal areas of curvature are formed inwardly relative to the side edges of the strip material and on both sides of the one side of each of two ribs, thereby forming two ribs.

8. In apparatus for roll forming longitudinal ribs in strip material, each rib having three substantially flat sides comprising two end sides and a centermost side therebetween said apparatus having a plurality of roll stands, each stand having a pair of upper and lower rollers for progressively forming the strip material as it passes through each roll stand, and comprising:

first roller means for engaging said strip material and dimensionally forming the centermost side of each of a plurality of ribs interconnected by areas of curvature, each centermost side being connected to the centermost side of adjacent ribs by an area of curvature;

second roller means for engaging said strip material and, while retaining the dimensional integrity of the centermost side of each rib, reforming the areas of curvature and dimensionally forming relatively flat sides connected by corners to the centermost side of each rib and an interconnecting area of less curvature; and third roller means for engaging said strip material to reshape the corners of each rib and flatten areas of said lesser curvature while retaining the dimensional integrity of the centermost side and the relatively flat sides of each rib.

9. The apparatus of claim 8, said first roller means having flattened areas for dimensionally forming the centermost side of each of three ribs and two pairs of complementary convex, concave surfaces for forming two areas of curvature interconnecting the centermost side of the centermost rib with the centermost side of the other two ribs.

10. The apparatus of claim 9, said second roller means comprising three areas of flatness for engaging and retaining the dimensional integrity of the centermost side of each rib and two pairs of complementary convex, concave surfaces for reforming the two areas of curvature and dimensionally forming one additional side to each rib and an interconnecting area of lesser curvature.

11. The apparatus of claim 10, said third roller means having three areas of flatness for engaging the centermost side of each of three ribs and other surfaces for engaging said strip material in areas of lesser curvature to reshape the corners of each rib, shorten the distance between ribs and flatten areas of strip intermediate the ribs.

* * * * *